US009206689B2

(12) United States Patent
Lee

(10) Patent No.: US 9,206,689 B2
(45) Date of Patent: Dec. 8, 2015

(54) ROTARY COMPRESSOR WITH VIBRATION REDUCTION AND OIL CONTROL

(71) Applicant: Samsung Electronics Co., Ltd., Suwon-si (KR)

(72) Inventor: Jeong Bae Lee, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 293 days.

(21) Appl. No.: 13/665,128

(22) Filed: Oct. 31, 2012

(65) Prior Publication Data

US 2013/0115122 A1 May 9, 2013

(30) Foreign Application Priority Data

Nov. 3, 2011 (KR) ..... 10-2011-0113660

(51) Int. Cl.

| | |
|---|---|
| ***F04C 18/356*** | (2006.01) |
| ***F04C 29/06*** | (2006.01) |
| ***F01C 21/10*** | (2006.01) |
| ***F04C 23/00*** | (2006.01) |

(52) U.S. Cl.

CPC ..... *F01C 21/10* (2013.01); *F04C 23/008* (2013.01); *F04C 18/356* (2013.01); *F04C 29/06* (2013.01); *F04C 2240/809* (2013.01); *F04C 2270/12* (2013.01)

(58) Field of Classification Search

CPC ..... F04C 2240/809; F04C 2270/12; F04C 19/06; F04C 18/356; F01C 21/102

USPC ..... 418/100

See application file for complete search history.

(56) References Cited

U.S. PATENT DOCUMENTS

| | | | | |
|---|---|---|---|---|
| 3,300,125 | A * | 1/1967 | Winkler | 417/363 |
| 6,514,047 | B2 * | 2/2003 | Burr et al. | 417/53 |
| 6,729,861 | B2 * | 5/2004 | Oh et al. | 417/417 |
| 6,807,821 | B2 * | 10/2004 | Narney, II | 418/100 |
| 2010/0098566 | A1 * | 4/2010 | Kang | 417/437 |
| 2013/0129539 | A1 * | 5/2013 | Lee | 417/410.5 |

FOREIGN PATENT DOCUMENTS

| | | | | |
|---|---|---|---|---|
| JP | 06117381 | A * | 4/1994 | F04C 15/02 |
| KR | 10-2003-0010870 | | 2/2003 | |
| KR | 10-2005-0007298 | | 1/2005 | |
| KR | 10-2006-0013218 | | 2/2006 | |
| WO | WO 2012090345 | A1 * | 7/2012 | |

* cited by examiner

*Primary Examiner* — Mary A Davis

(74) *Attorney, Agent, or Firm* — Staas & Halsey LLP

(57) ABSTRACT

A rotary compressor having an improved supporting structure and a smaller size thereof, reducing the vibration and noise and providing various fields of application other than an air conditioner, the rotary compressor provided with a compression part and a driving part and including a first case forming an external appearance of the rotary compressor, a second case provided inside the first case and provided with the compression part and the driving part at an inner side thereof, and a supporting member configured to support the second case and provided at an inner side of the first case.

12 Claims, 5 Drawing Sheets

ROTARY COMPRESSOR WITH VIBRATION REDUCTION AND OIL CONTROL

CROSS-REFERENCE TO RELATED APPLICATIONS

This application claims the priority benefit of Korean Patent Application No. 10-2011-0113660, filed on Nov. 3, 2011 in the Korean Intellectual Property Office, the disclosure of which is incorporated herein by reference.

BACKGROUND

1. Field

Embodiments relate to a rotary compressor, and more particularly, to a rotary compressor having an enhanced support structure and a smaller size thereof.

2. Description of the Related Art

In general, a compressor is an apparatus configured to compress a fluid such as air or refrigerant by applying a pressure to the fluid by receiving a power from a driving apparatus such as an electric motor and to discharge the compressed fluid. A compressor is generally used in a product such as an air conditioner or a refrigerator.

A compressor is classified into a positive displacement-type compressor and a turbo-type compressor. The positive displacement-type compressor includes a rotary compressor configured to compress a fluid by a roller that eccentrically rotates at an inside a cylinder.

A rotary compressor is provided with a sealed accommodating space at an inside thereof, and includes a case provided with an suction port and a discharging port formed thereon, a driving part installed at an inside the case, a compression part connected to the driving part and configured to compress a refrigerant, and an accumulator connected to the suction port of the case while communicating with the compression part. One side of the case is provided with a suction pipe connected thereto to receive a fluid from the accumulator, and the suction pipe is welded with the suction port of the case.

When a refrigerant is introduced to the accumulator, the refrigerant is stored inside the accumulator. In a case of a liquid refrigerant, the liquid refrigerant is vaporized and then introduced to the compression chamber of the compression part. In general, the accumulator serves to prevent a valve of a compressor from being damaged by a refrigerant in a liquid state introduced into a compression chamber. The accumulator also serves to return oil, which is mixed with the refrigerant that is compressed at the compressor, to the compressor.

A compression part is fixed by use of welding, and a driving part is press-fitted into a case. As the driving part is press-fitted into the case, the noise and vibration of the driving part and compression part are delivered to the case, thereby resulting in greater noise and vibration when compared to other types of compressors.

In addition, the size of a rotary compressor is increased as an accumulator is mounted thereon.

SUMMARY

In an aspect of one or more embodiments, there is provided a rotary compressor capable of reducing noise and vibration and having a smaller size thereof.

In accordance with an aspect of one or more embodiments, there is provided a rotary compressor having a compression part and a driving part, the rotary compressor including a first case, a second case and a supporting member. The first case may form an external appearance of the rotary compressor.

The second case may be provided at an inside the first case and provided with the compression part and the driving part at an inner side thereof. The supporting member may be configured to support the second case and provided at an inner side of the first case.

The rotary compressor may further include a first suction port provided at the first case and allowing the inside of the first case to communicate with the inside the second case.

The rotary compressor may further include a suction pipe having a shape of a pipe, connected to the first suction port and provided with an inlet formed at an upper portion of the inside of the first case for the introduction of a refrigerant.

The suction pipe is provided with an oil hole formed at a certain position thereof at which a distance between the suction pipe and a lower side of the first case is minimum so that the oil is introduced to an inside the second case.

The rotary compressor may further include a capillary tube connected to the first suction port and allowing oil to be introduced to an inside the second case.

The capillary tube may be bent and connected in a direction toward a lower side of the first case.

The rotary compressor may further include a netted part connected to the first suction port and formed in a structure of a net so that the oil is drawn into an inside the second case by use of osmotic phenomenon.

The rotary compressor may further include a second suction port formed at one side of the first case so as to draw a refrigerant from an outer side of the first case.

The rotary compressor may further include a discharging part formed in a shape of a pipe and connected from an upper side of the first case to an upper side of the second case so that gas at an inner side the second case is discharged to an outer side of the first case.

The discharging part may be formed with flexible material to prevent noise and vibration from being delivered to the first case.

The discharging part may be elongated so as to be bent at an inner side of the first case to prevent noise and vibration from being delivered to the first case.

The supporting member may a first elastic member configured to support a lower side of the second case and a second elastic member configured to support both lateral sides of the second case.

In accordance with an aspect of one or more embodiments, there is provided a rotary compressor having a first case forming an external appearance thereof and a second case provided at an inner side of the first case, the rotary compressor including a low pressure chamber, a high pressure chamber and a discharging part. The low pressure chamber may be provided in between the first case and the second case. The high pressure chamber may be provided at an inside the second case. The discharging part may be configured to discharge gas to an outer side of the low pressure chamber from the high pressure chamber.

The volume of the low pressure chamber may be equal to or greater than half the volume of liquefied refrigerant introduced to the high pressure chamber.

The rotary compressor may further include a supporting member provided at the low pressure chamber to support the second case.

The rotary compressor may further include a first suction port that is formed at the second case while connecting the low pressure chamber to the high pressure chamber so that refrigerant moves from the low pressure chamber to the high pressure chamber.

The rotary compressor may further include a suction part connected to the first suction port and configured to return oil to an inside the high pressure chamber.

The suction part may be formed with a suction pipe having a shape of a pipe, and is provided with an oil hole formed at a certain position thereof at which a distance between the suction pipe and a lower side of the first case is minimum so that the oil is returned from the low pressure chamber to the high pressure chamber.

The suction part may be a capillary tube so that the oil returns from the low pressure chamber to the high pressure chamber through a capillary phenomenon.

The suction part may be a netted part having a form of a net so that the oil returns from the low pressure chamber to the high pressure chamber through an osmotic phenomenon.

The discharging part may be provided in a form of a pipe and elongated so as to be bent at an inner side of the low pressure chamber so that noise and vibration are prevented from being delivered toward an outer side of the low pressure chamber.

In accordance with one or more embodiments, there is provided a rotary compressor has a low-vibration and low-noise compressor while having a smaller size thereof. Accordingly, the rotary compressor may be used for various fields other than for an air conditioner.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
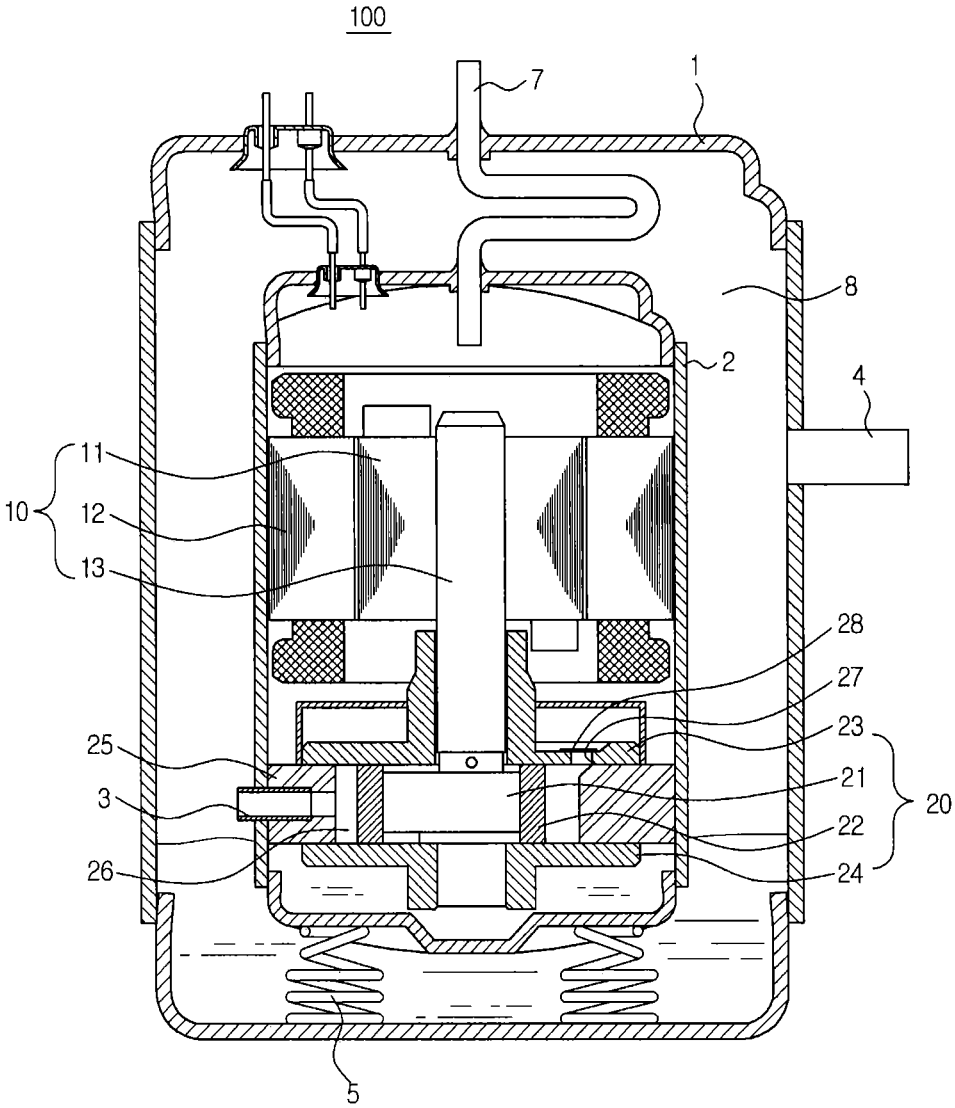
FIG. 1 is a drawing illustrating a rotary compressor in accordance with an embodiment.

Reference will now be made in detail to embodiments, examples of which are illustrated in the accompanying drawings, wherein like reference numerals refer to like elements throughout.

FIG. 1 is a drawing illustrating a rotary compressor according to an embodiment.

As illustrated in FIG. 1, a rotary compressor 100 according to an embodiment includes a first case 1 forming an exterior, and a second case 2 provided inside the first case 1. The second case 2 is provided inside thereof with a driving part 10 to generate a driving force, and a compression part 20 to compress refrigerant gas by receiving the driving force of the driving part 10. The driving part 10 and the compression part 20 are installed at an inside the second case 2 which is sealed and having a shape of a cylinder.

One side of the lower portion of the second case 2 is provided with a first suction port 3 communicating with the first case 1. A lower portion of the first case 1 is provided with oil stored therein.

An upper side of the second case 2 is provided with a discharging part 7 installed thereto, and the discharging part 7 is connected to an upper side of the first case 1 and configured to discharge the refrigerant gas, which is compressed at the compression part 20 inside the second case 2, from inside the second case 2 to outside the first case 1. The discharging part 7 may be provided with a shape of a tube. The discharging part 7 may be formed with flexible material to prevent the noise and vibration of the driving part 10 and the compression part 20 inside the second case 2 from being delivered to outside the case 1. A rubber tube, a type of a Teflon® tube, as an example, may be used.

The discharging part 7 may be provided in an elongated shape to reduce noise and vibration, and in the case as such, the discharging part 7 is bent at an inner side of the first case 1. Thus, the noise and vibration of the compression part 20 and the driving part 10 inside the second case 2 may be prevented from being delivered to the first case 1. In addition, in a case when the discharging part 7 is formed in an elongated manner, the material of the discharging part 7 is not needed to be formed with flexible material to attain a low-noise, low-vibration effect.

A supporting member is provided at a lower portion of the first case 1 to support an assembly of the compression part 20 and the driving part 10. Although a first elastic member 5 is illustrated on FIG. 1, it is not limited hereto, and a damper may be installed at a lower portion of the first case 1. The position of the supporting member is not limited to a lower portion of the first case 1.

The first elastic member 5 is mounted to the first case 1, and is insertedly mounted to the first case 1 through a groove (not shown) configured for the first elastic member 5 to be mounted to the first case 1. The first elastic member 5 is compressed through a pre-loading.

The driving part 10 includes a stator 12, a rotator 11 rotatively supported inside the stator 12, and a rotation shaft 13 is inserted into the rotator 11 in a pressed manner. As a power is applied to the stator 12, the rotator 11 is rotated by an electromagnetic force, and the rotation shaft 13 integrally formed by being pressedly inserted into the rotator 11 delivers the rotation force to the compression part 20.

The compression part 20 includes an eccentric part 21 formed at one side of a lower portion of the rotation shaft 13, a roller 22 insertedly installed at an outer side of the eccentric part 21, and a cylinder 25 provided to form a compression chamber 26 at which the roller 22 is accommodated. In addition, the compression part 20 may include an upper portion bearing 23 and a lower portion bearing 24, to seal the compression chamber 26, coupled to an upper portion and a lower portion of the cylinder 25, respectively, and provided to support the rotation shaft 13.

One side of the cylinder 25 is provided with a first suction port 3 connected to an inside the first case 1, and the other side of the cylinder 25 is provided with a discharging port (not shown) to guide the refrigerant gas compressed at the compression chamber 26 to outside the compression chamber 26.

One side of the upper bearing 23 is provided with a discharging hole 27 communicating with the discharging port (not shown) such that the refrigerant gas guided to the discharging port (now shown) is guided to an outside. The upper portion bearing 23 is provided with a valve apparatus 28 at an upper side thereof at a discharging hole side to open/close the discharging hole 27.

A carbon dioxide refrigerant and oil are introduced to the first suction port 3 and are supplied to the compression chamber 26, and the inside the compression chamber 26 is filled with the oil. The oil functions to help the operation of the compression part 20 perform smoothly.

The supporting member is configured to form a space 8 in between the first case 1 and the second case 2. The space 8 may function as an accumulator. Since the space 8 is formed in between the first case 1 and the second case 2 and the discharging part 7 is formed with flexible material or formed in an elongated shape and bent at an inner side of the first case, noise and vibration may be absorbed.

The space 8 in between the first case 1 and the second case 2 may be provided with a greater volume than the volume of a general accumulator so that the space 8 may function as an accumulator, and for example, the volume of the space 8 may be greater than half the volume of the liquefied refrigerant introduced to an inside of the rotary compressor 100.

One side of the first case 1 is provided with a second suction port 4 thereto to draw refrigerant from an outer side of the first case 1, and the second suction port 4, instead of an accumulator, may draw the refrigerant from an outer side of the first case 1. The second suction port 4 may be installed at an upper side of the first case 1 to efficiently draw refrigerant and to prevent oil inside the first case 1 from leaking therefrom.

The refrigerant having a low temperature and a low pressure inside the rotary compressor 100 according to one embodiment of the present disclosure is introduced to the space 8 in between the first case 1 and the second case 2 through the second suction port 4 of the first case 1. The refrigerant is introduced to the compression chamber 26 of the rotary compressor 100 through the first suction port 3 in between the first case 1 and the second case 2. In a case of a liquefied refrigerant, the liquefied refrigerant is vaporized in the space in between the first case 1 and the second case 2 and is introduced to the compression chamber 26 in a state of a vapor.

In addition, oil and refrigerant are accumulated in a space at a lower side of the first case 1, and the oil and refrigerant as such perform in reducing the noise and vibration of the compressor 100.

The first case 1 and the second case, 2 may be formed with steel material. However, since a high pressure is formed inside the second case 2 and a low pressure is formed inside the first case 1, the first case 1 may use thinner material when compared to the material used for the second case 2.

Figure 2:
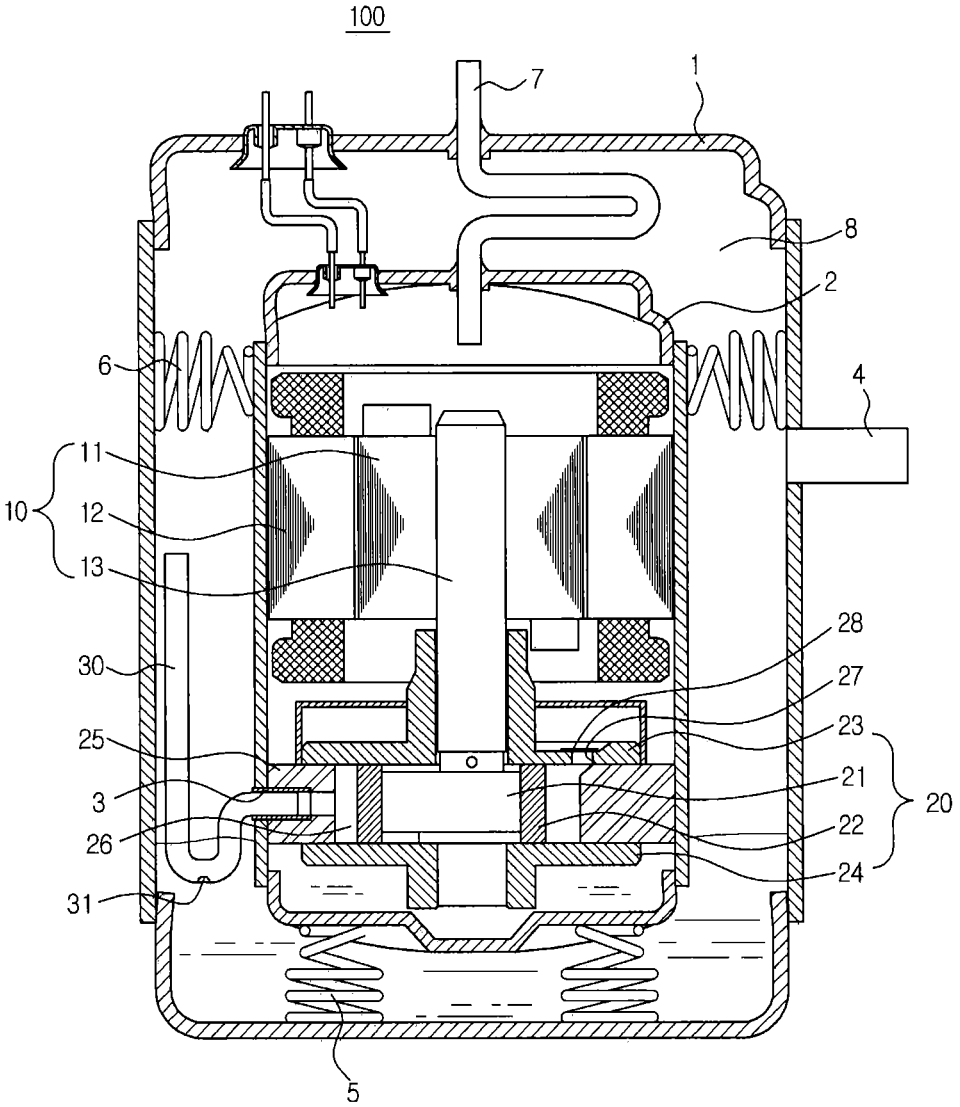
FIG. 2 is a drawing illustrating a rotary compressor in accordance with an embodiment.
Figure 3:
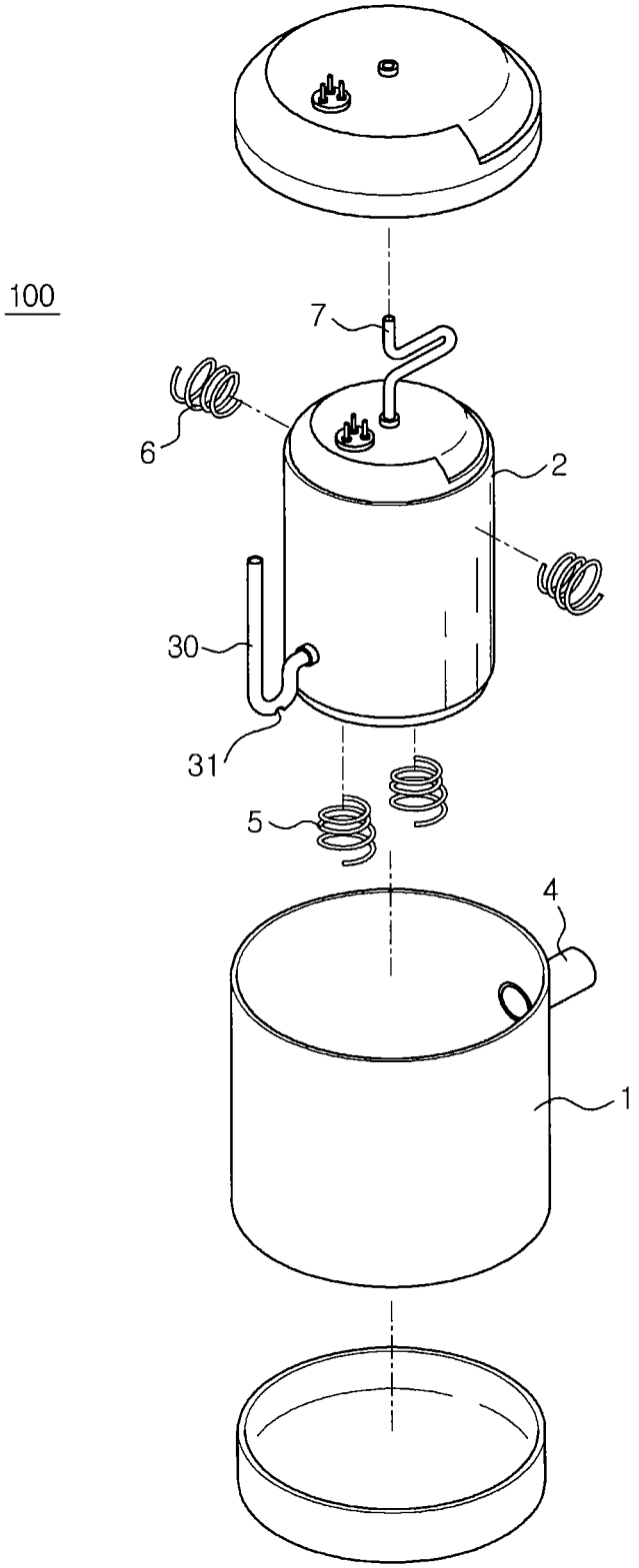
FIG. 3 is an exploded view illustrating a rotary compressor in accordance with an embodiment.

FIG. 2 is a drawing illustrating a rotary compressor according to an embodiment, and FIG. 3 is an exploded view illustrating a rotary compressor according to an embodiment.

According to an embodiment illustrated on FIG. 2, a lower side and a lateral side of the first case 1 are provided with a first elastic member 5 and a second elastic member 6. The second elastic member 6 is configured to support the second case 2 from the lateral side of the first case 1. The second elastic member 6 is mounted to the first case 1 in the same manner as the first elastic member 5 is mounted.

The first suction port 3 of the second case 2 is provided thereto with a suction pipe 30 having a shape of a pipe so that the oil and refrigerant inside the first case 1 may be introduced to an inside the second case 2. As the rotary compressor 100 is operated, the oil along with refrigerant gas in the compression chamber 26 is discharged from the second case 2 to the first case 1. In a case when the oil inside the second case 2 is depleted, the reliability of the compressor 100 is lowered and the compartments thereof are abrased. Thus, there is a need for a technology to introduce oil from the first case 1, which is a low pressure chamber, to the second case 2, which is a high pressure chamber. To this end, the rotary compressor 100 according to the present disclosure is provided with a suction part. An oil hole 31 provided at the suction pipe 30 may function as the suction part.

The suction pipe 30 connects from the first suction port 3 to a lower side of the first case 1, and to an upper side of the case 1 for an efficient introduction of refrigerant. Thus, the suction pipe 30 has four sections defined with respect to respective bending positions at which the suction pipe 30 is bent upward or downward. The suction pipe 30 is provided with the oil hole 31 formed at a position of the four sections at which the distance between the suction pipe 30 and a lower side of the first case 1 is minimum so that the oil may be returned to an inside the second case 2. In other words, the suction pipe 30 is submerged in the oil stored inside the first case 1, so that the oil may be efficiently introduced to the suction pipe 30.

For the position at which the first suction port 3 is provided, a low pressure is formed every time when the cylinder 25 inside the compression part 20 rotates once. Thus, a low pressure is also formed inside the suction pipe 30 connected to the first suction port 3, so that the oil may be introduced inside the suction pipe 30 through the oil hole 31 from a lower side of the first case 1. The oil introduced to the suction pipe 30 is introduced to the first suction port 3, and then is returned to an inside the compression part 20.

The cross-sectional area of the oil hole 31 provided at the suction pipe 30 is about $1\pi$~$2\pi$. In addition, the suction pipe 30 may be formed with copper material, but not limited hereto.

Figure 4:
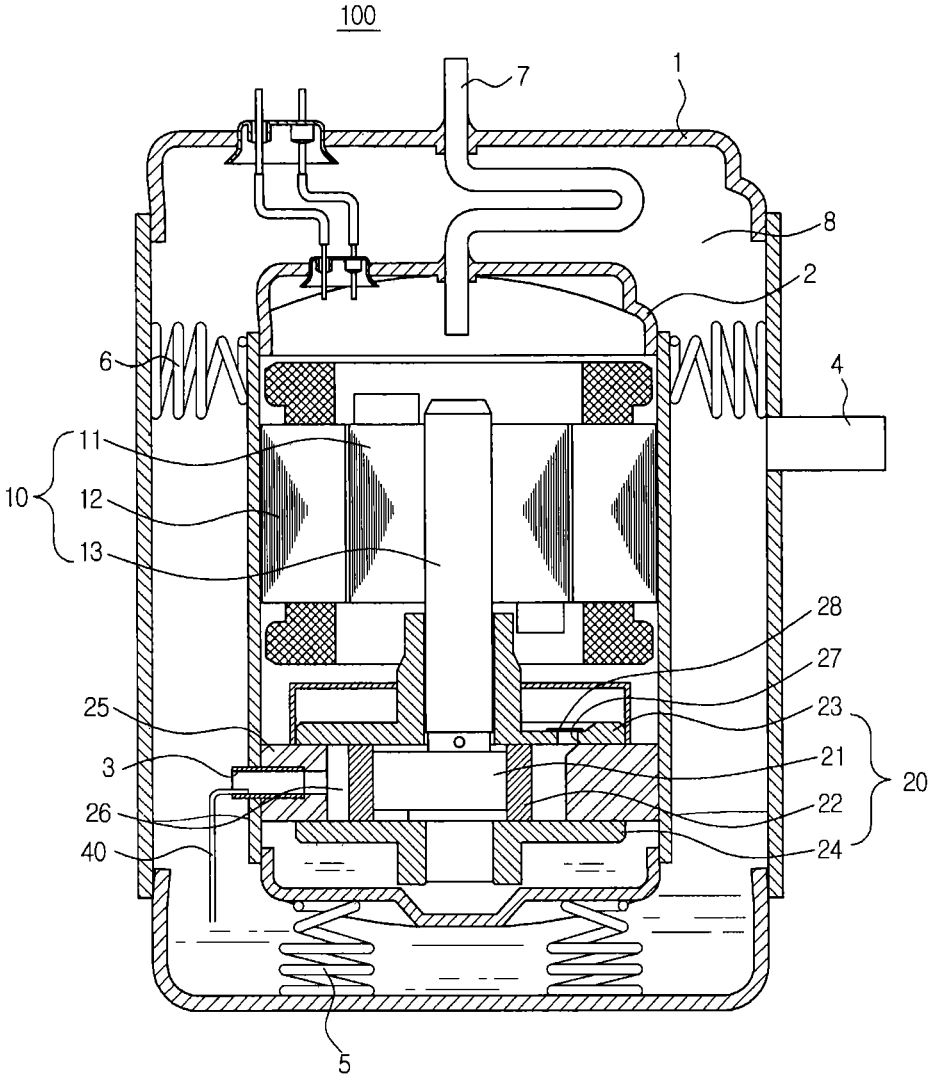
FIG. 4 is a drawing illustrating a rotary compressor in accordance with an embodiment.

FIG. 4 is a drawing illustrating a rotary compressor according to still another embodiment of the present disclosure.

According to the embodiment of the present disclosure illustrated on FIG. 4, a capillary tube is used as a suction part. A capillary tube 40 is connected to the first suction port 3. The capillary tube 40 is bent and connected in a direction toward a lower side of the first case 1, so that the capillary tube 40 is submerged in the oil at a lower side of the first case 1.

In a case when the capillary tube is provided in a standing position in a liquid, if the liquid inside the tube is the liquid that is smeared on the tube, the liquid level inside the tube is ascended, and if the liquid inside the tube is the liquid that is not smeared on the tube, the liquid level inside the tube is descended, and the phenomenon as such is referred to as a capillary phenomenon. In a case when the adhesiveness between molecules of the liquid and molecules of material forming the tube is greater than the cohesiveness of the liquid, the liquid level inside the tube is ascended beyond the surface. In a case when the adhesiveness of molecules of the liquid and molecules of material forming the tube is smaller (less) than the cohesiveness of the liquid, the liquid level inside the tube is descended below the surface.

The capillary tube 40 is then submerged in the oil at a lower side of the first case 1, and the oil is ascended near the first suction port 3 by the capillary phenomenon. Since a low pressure is periodically formed at the first suction port 3, the oil ascended by the capillary phenomenon is introduced to the compression chamber 26. The refrigerant is drawn to the compression chamber 26 through the first suction port 3.

The cross-sectional area of the capillary tube may be provided at about $3\pi$. In a case when using the capillary tube 40, the installation may be easier than using the suction pipe 30 having a shape of a pipe.

Figure 5:
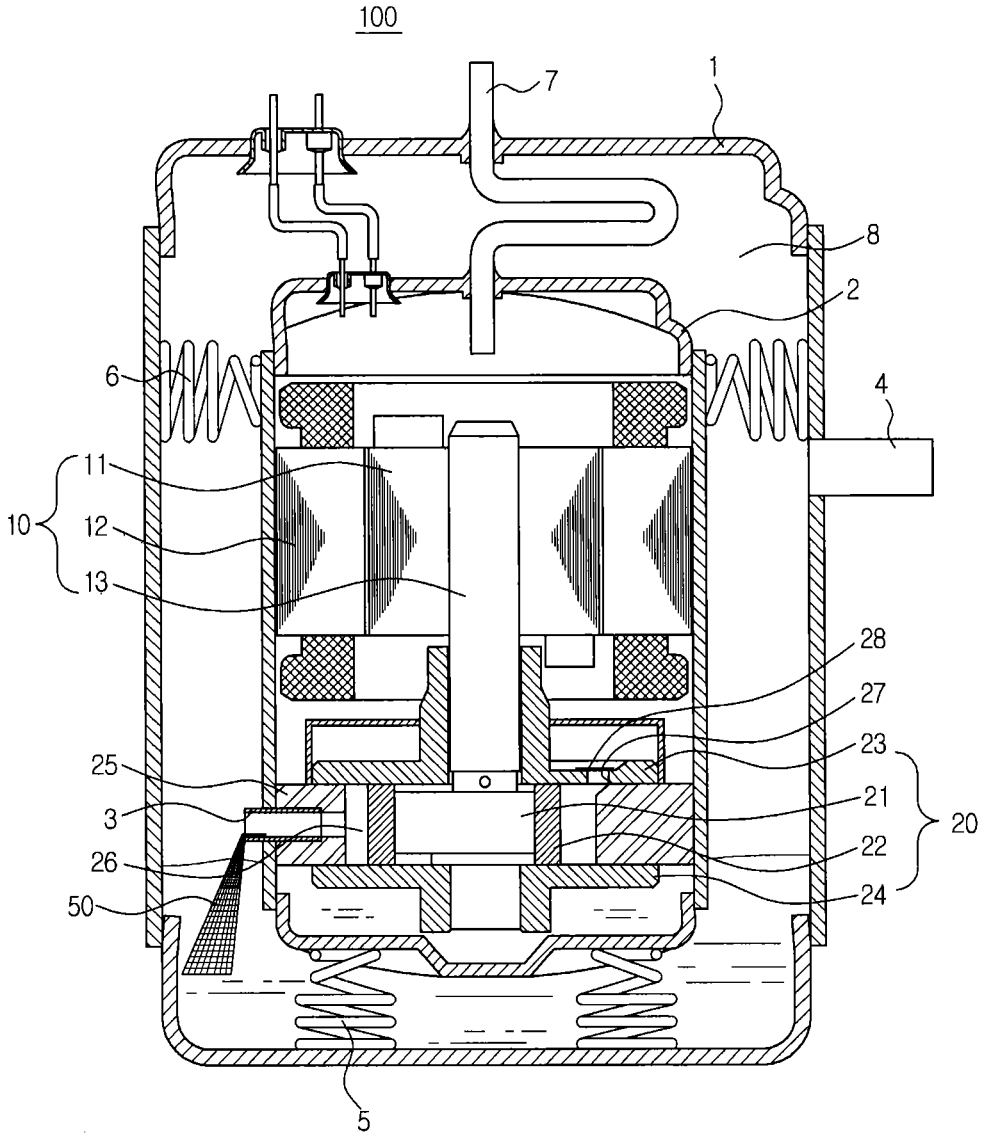
FIG. 5 is a drawing illustrating a rotary compressor in accordance with an embodiment.

FIG. 5 is a drawing illustrating a rotary compressor according to still another embodiment of the present disclosure. As illustrated on FIG. 5, the suction part is a netted part 50 formed in a netted structure so that the oil may be drawn to an inside the second case 2.

In a case when a solution and solvent are divided by use of semi-permeable film, the film through which the solvent may penetrate freely while the solute may not be able to penetrate, the solvent passes into the solution, and the phenomenon as such is referred to as an osmotic phenomenon. As the solution and solvent are divided by the semi-permeable film, the solvent flows toward the solution by osmotic phenomenon, thereby increasing the height of the solution. At this time, if a greater pressure is applied to the solution, the solvent may be prevented from flowing toward the solution, and the pressure applied at this time is referred to as an osmotic pressure.

The netted part 50 according to the embodiment of the present disclosure uses the osmotic phenomenon. The netted part 50 suspended from the first suction port 3 toward the oil at a lower side of the first case 1 functions as the semi-permeable film, and the oil is guided to ascend though the net by the osmotic phenomenon. The oil guided to ascend to the first suction port 3, since the first suction port 3 is at a low pressure, is drawn into the compression chamber 26 having a high pressure.

The netted part 50 may be formed with metallic or cloth material, and the osmotic phenomenon may take place as a net structure is formed thereto. The oil discharged toward an inner side of the first case 1 from the compression part 20 by the netted part 50 may be returned to an inner side of the second case 2.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A rotary compressor having a compression part and a driving part, the rotary compressor comprising:

a first case which provides an external surface of the rotary compressor;

a second case provided inside the first case and provided with the compression part and the driving part at an inner side of the second case;

a supporting member configured to support the second case and provided at an inner side of the first case;

a first suction port provided at the second case and allowing the inside of the first case to communicate with the inside of the second case; and a suction pipe connected to the first suction port and provided with an inlet formed at an upper portion of the inside of the first case for the introduction of a refrigerant, wherein the suction pipe is provided with an oil hole formed at a certain position of the suction pipe at which a distance between the suction pipe and a lower side of the first case is minimum so that oil is introduced to an inside of the second case.

2. The rotary compressor of claim 1, further comprising:

a second suction port formed at one side of the first case so as to draw the refrigerant from an outer side of the first case.

3. The rotary compressor of claim 1, further comprising:

a discharging part formed in a shape of a pipe and connected from an upper side of the first case to an upper side of the second case so that gas at an inner side the second case is discharged to an outer side of the first case.

4. The rotary compressor of claim 3, wherein the discharging part is formed with flexible material to prevent noise and vibration from being delivered to the first case.

5. The rotary compressor of claim 3, wherein the discharging part is elongated so as to be bent at an inner side of the first case to prevent noise and vibration from being delivered to the first case.

6. The rotary compressor of claim 1, wherein the supporting member comprises a first elastic member configured to support a lower side of the second case and a second elastic member configured to support both lateral sides of the second case.

7. The rotary compressor of claim 1, wherein the discharging part is formed with flexible material to prevent noise and vibration from being delivered outside of the first case.

8. The rotary compressor of claim 1, wherein the discharging part is elongated so as to be bent at an inner side of the first case to prevent noise and vibration from being delivered outside of the first case.

9. A rotary compressor having a first case which provides an external surface of the rotary compressor and having a second case provided at an inner side of the first case, the rotary compressor comprising:

a low pressure chamber provided in between the first case and the second case;

a high pressure chamber which is the second case;

a discharging part configured to discharge gas to an outer side of the low pressure chamber from the high pressure chamber, a first suction port provided at the second case and while connecting the low pressure chamber to the high pressure chamber so that refrigerant moves from the low pressure chamber to the high pressure chamber; and a suction pipe connected to the first suction port and configured to return oil to inside the high pressure chamber, wherein the suction pipe is provided with an oil hole formed at a certain position of the suction pipe at which a distance between the suction pipe and a lower side of the first case is minimum so that oil is returned from the low pressure chamber to the high pressure chamber.

10. The rotary compressor of claim 9, wherein the volume of the low pressure chamber is equal to or greater than half the volume of the refrigerant introduced to the high pressure chamber.

11. The rotary compressor of claim 9, further comprising:

a supporting member provided at the low pressure chamber to support the second case.

12. The rotary compressor of claim 9, wherein the discharging part is provided in a form of a pipe and elongated so as to be bent at an inner side of the low pressure chamber so that noise and vibration are prevented from being delivered toward an outer side of the low pressure chamber.

* * * * *